US009549443B2

(12) United States Patent
Bradford

(10) Patent No.: US 9,549,443 B2
(45) Date of Patent: Jan. 17, 2017

(54) DETECTION OF LINEAR AND PWM DIMMING IN A SOLID STATE LIGHTING DEVICE

(71) Applicant: Cree, Inc., Durham, NC (US)

(72) Inventor: Everett Bradford, Apex, NC (US)

(73) Assignee: Cree, Inc., Durham, NC (US)

( * ) Notice: Subject to any disclaimer, the term of this patent is extended or adjusted under 35 U.S.C. 154(b) by 525 days.

(21) Appl. No.: 14/063,923

(22) Filed: Oct. 25, 2013

(65) Prior Publication Data

US 2015/0115811 A1 Apr. 30, 2015

(51) Int. Cl.
*H05B 33/08* (2006.01)

(52) U.S. Cl.
CPC ..... *H05B 33/0848* (2013.01); *H05B 33/083* (2013.01)

(58) Field of Classification Search
None
See application file for complete search history.

(56) References Cited

U.S. PATENT DOCUMENTS

2011/0187283 A1* 8/2011 Wang ..... H05B 37/02 315/291
2013/0015774 A1* 1/2013 Briggs ..... H05B 33/0815 315/186

* cited by examiner

*Primary Examiner* — Douglas W Owens
*Assistant Examiner* — Dedei K Hammond
(74) *Attorney, Agent, or Firm* — Withrow + Terranova, P.L.L.C.

(57) ABSTRACT

A lighting device employs an array of LEDs as a lighting source. The array of LEDs may be coupled in series between a power supply node and ground. In order to determine whether the input drive signal to the array of LEDs is a pulse width modulated (PWM) signal or a linear signal, the voltage across the string of LEDs is sampled and stored in a cyclical buffer. The variance of the samples stored in the cyclical buffer is then calculated and used to determine whether the input signal provided to the string of LEDs at the power supply node is a PWM signal or a linear signal. In one embodiment, the variance is compared to a predetermined threshold value to determine whether the input signal is a PWM signal or a linear signal.

34 Claims, 9 Drawing Sheets

DETECTION OF LINEAR AND PWM DIMMING IN A SOLID STATE LIGHTING DEVICE

FIELD OF THE DISCLOSURE

The present disclosure relates to a solid-state lighting device that is capable of detecting characteristics of the power supply used to drive the lighting device.

BACKGROUND

In recent years, a movement has gained traction to replace incandescent light bulbs with solid-state lighting devices that employ more efficient lighting technologies. One such technology that shows tremendous promise employs light emitting diodes (LEDs). Compared with incandescent bulbs, LED lighting devices are much more efficient at converting electrical energy into light and are longer lasting. As a result, lighting fixtures that employ LED technologies are expected to eventually replace incandescent bulbs in residential, commercial, and industrial applications.

The growing popularity of LED lighting products has resulted in a large number of both LED lighting devices and LED lighting power supplies on the market. Generally, an LED lighting device includes a fixture designed around one or more LEDs, while an LED lighting power supply provides power to the LED lighting device. Current LED lighting devices are generally designed specifically for a single LED lighting power supply, resulting in incompatibility between different product lines and brands. Accordingly, there is currently very little flexibility provided to LED lighting consumers.

Additionally, while LED lighting devices offer efficiency and longevity improvements over their incandescent counterparts, LED lighting devices may also behave differently than incandescent bulbs. For example, the color temperature of the light emitted by an LED lighting device may be substantially different from that emitted by an incandescent bulb. The difference in behavior between incandescent bulbs and LED lighting devices may upset consumer expectations, thereby slowing the adoption of LED lighting products.

Accordingly, an LED lighting device is needed that is compatible with multiple LED lighting power supplies and capable of more closely imitating the characteristics of an incandescent bulb.

SUMMARY

The present disclosure relates to a lighting device that employs an array of LEDs as a lighting source. The array of LEDs may be coupled in series between a power supply node and ground. In order to determine whether the input drive signal to the array of LEDs is a pulse width modulated (PWM) signal or a linear signal, the voltage across the string of LEDs is sampled and stored in a cyclical buffer. The variance of the samples stored in the cyclical buffer is then calculated and used to determine whether the input signal provided to the string of LEDs at the power supply node is a PWM signal or a linear signal. In one embodiment, the variance is compared to a predetermined threshold value to determine whether the input signal is a PWM signal or a linear signal.

According to one embodiment, if it is determined that the input signal is linear, one or more operations may be performed to determine whether the string of LEDs is turning off. For example, a moving average may be calculated based on the samples in the cyclical buffer and used to detect when the string of LEDs is turning off, thereby allowing one or more actions to be taken in order to properly shut down the string of LEDs.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

Figure 1:
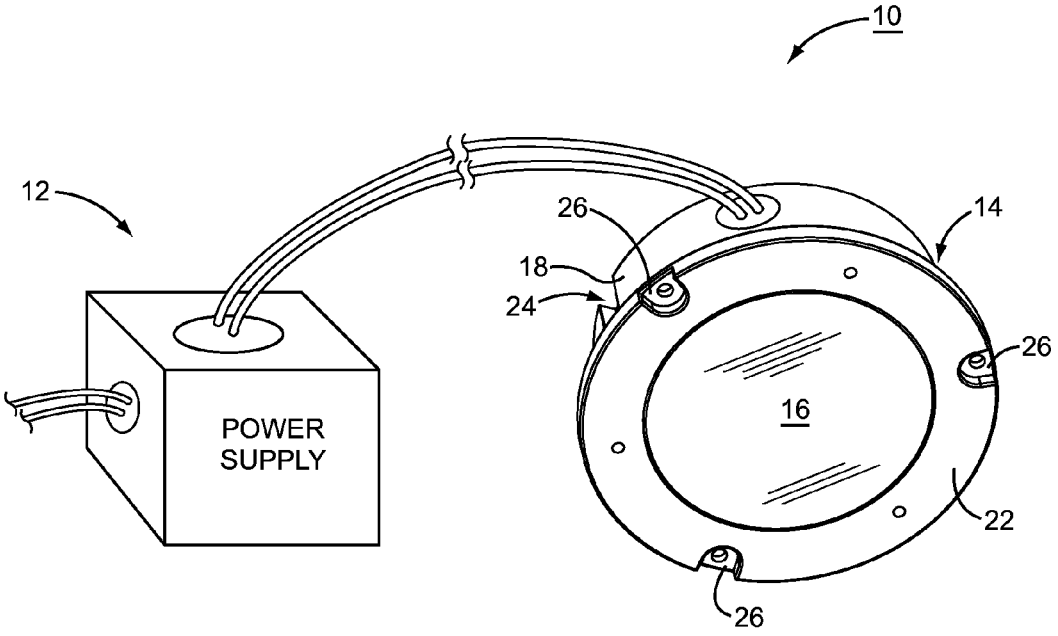
FIG. 1 is an isometric view of the front of an exemplary lighting device and power supply according to one embodiment of how the disclosure may be implemented.
Figure 2:
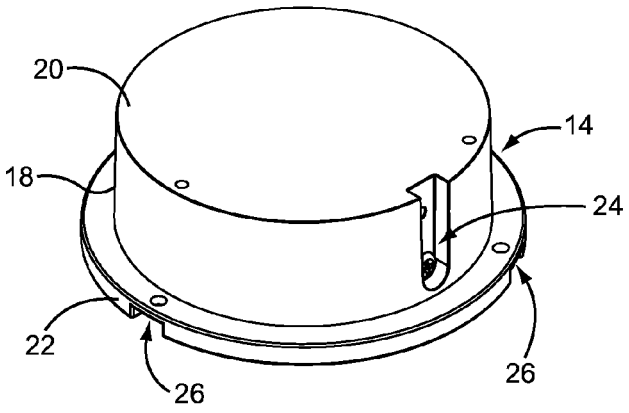
FIG. 2 is an isometric view of the back of the lighting device of FIG. 1.

The present disclosure relates to a solid-state lighting device that is capable of accurately measuring voltage and current conditions within the lighting device. For context and ease of understanding, the following description first describes an exemplary solid-state lighting device prior to describing how the solid-state lighting device may be configured to handle over-temperature conditions. With reference to FIGS. 1 and 2, a unique lighting device 10 and power supply 12 are illustrated according to one embodiment of the present disclosure. While this particular lighting device 10 is used for reference, those skilled in the art will recognize that virtually any type of solid-state lighting device may benefit from the subject disclosure.

As shown, the lighting device 10 includes a mounting structure 14 and a lens 16. The illustrated mounting structure 14 is cup-shaped and is capable of acting as a heat spreading device; however, different fixtures may include different mounting structures 14 that may or may not act as heat spreading devices. A light source (not shown), which will be described in detail further below, is mounted inside the mounting structure 14 and oriented such that light is emitted from the mounting structure 14 through the lens 16. The electronics (not shown) that are required to drive the light source are described further below. The power supply 12 is typically coupled to an alternating current (AC) source and used to provide power to the electronics of the lighting device 10. While the lighting device 10 is envisioned to be used predominantly in 4, 5, and 6 inch recessed lighting applications for industrial, commercial, and residential applications, those skilled in the art will recognize that the concepts disclosed herein are applicable to virtually any size and application.

The lens 16 may include one or more lenses that are made of clear or transparent materials, such as polycarbonate or acrylic glass or any other suitable material. As discussed further below, the lens 16 may be associated with a diffuser for diffusing the light emanating from the light source and exiting the mounting structure 14 via the lens 16. Further, the lens 16 may also be configured to shape or direct the light exiting the mounting structure 14 via the lens 16 in a desired manner.

The power supply 12 and the lighting device 10 may be modular, wherein different sizes, shapes, and types of power supplies 12 may be connected or otherwise coupled to the mounting structure 14 of the lighting device 10 using an appropriate wiring harness. While shown as being physically separate, the power supply 12 and the lighting device 10 may be integrated to form a single structure. According to one embodiment, the lighting device 10 is compatible with a variety of power supplies 12, as discussed in further detail below.

In the illustrated embodiment, the mounting structure 14 is cup-shaped and includes a sidewall 18 that extends between a bottom panel 20 at the rear of the mounting structure 14, and a rim, which may be provided by an annular flange 22 at the front of the mounting structure 14. One or more elongated slots 24 may be formed in the outside surface of the sidewall 18. There are two elongated slots 24, which extend parallel to a central axis of the lighting device 10 from the rear surface of the bottom panel 20 toward, but not completely to, the annular flange 22. The elongated slots 24 may be used for a variety of purposes, such as providing a channel for a grounding wire that is connected to the mounting structure 14 inside the elongated slot 24, connecting additional elements to the lighting device 10, or as described further below, securely attaching the lens 16 to the mounting structure 14.

The annular flange 22 may include one or more mounting recesses 26 in which mounting holes are provided. The mounting holes may be used for mounting the lighting device 10 to a mounting structure or for mounting accessories to the lighting device 10. The mounting recesses 26 provide for counter-sinking the heads of bolts, screws, or other attachment means below or into the front surface of the annular flange 22.

Figure 3A:
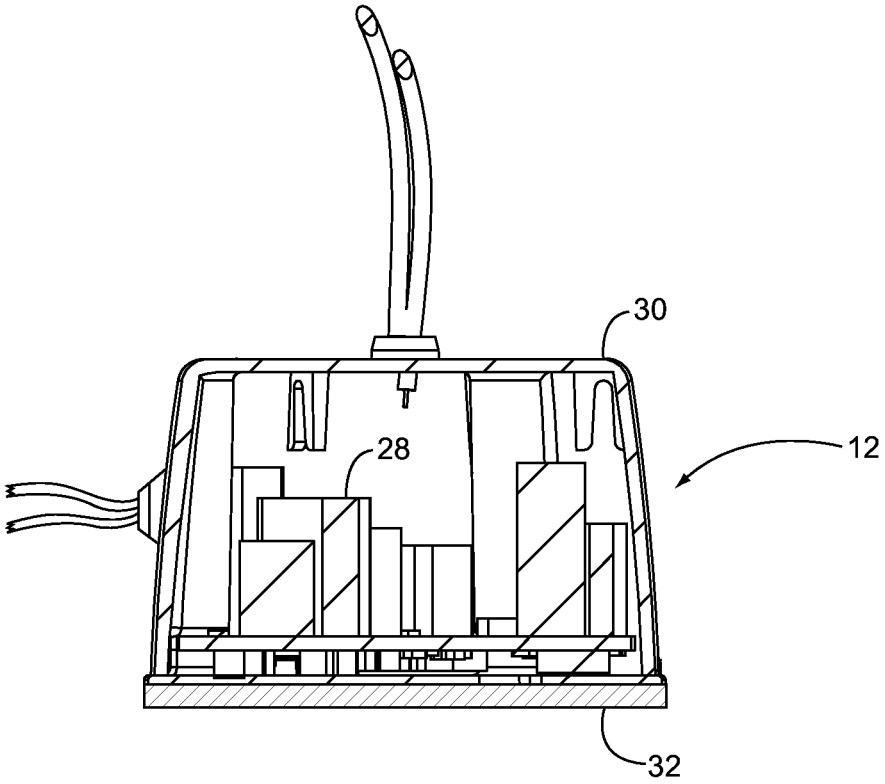
FIG. 3A is cross-sectional view of the power supply of FIG. 1.

With reference to FIG. 3A, a cross-sectional view of the power supply 12 of FIG. 1 is provided. As illustrated, the power supply 12 includes power supply electronics 28, which are encapsulated by a power supply housing 30 and a power supply cover 32. The power supply housing 30 is cup-shaped and sized sufficiently to receive the power supply electronics 28. The power supply cover 32 provides a cover that extends substantially over the opening of the power supply housing 30. Once the power supply cover 32 is in place, the power supply electronics 28 are contained within the power supply housing 30 and the power supply cover 32.

Figure 3B:
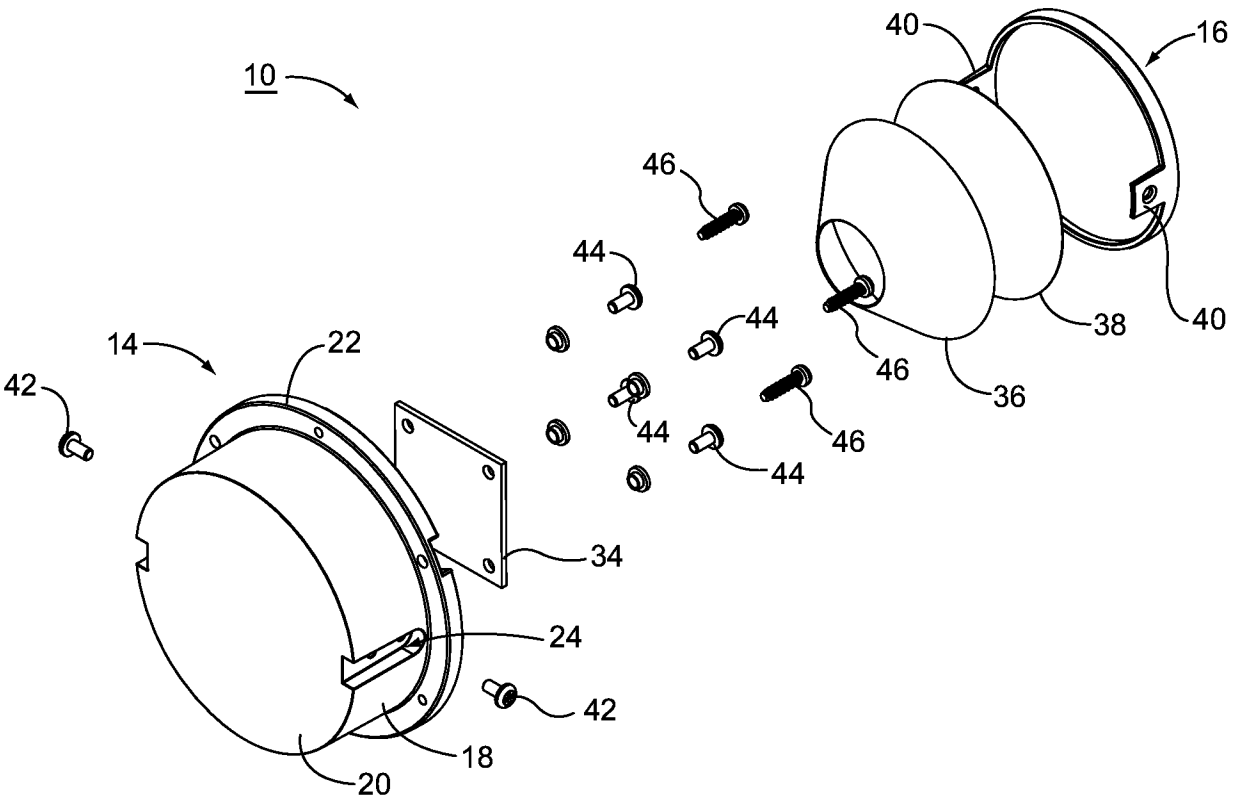
FIG. 3B is an exploded isometric view of the lighting device of Figure

The power supply electronics 28 may be used to provide power and potentially certain control signals necessary to power and control a light source module of the lighting device 10. With reference to FIG. 3B, the back of a light source module 34 is illustrated within an exploded view of the lighting device 10. The light source module 34 may be mounted on the front surface of the bottom panel 20 of the mounting structure 14 as shown, or in an aperture provided in the bottom panel 20 (not shown). Aligned holes or openings in the bottom panel 20 of the mounting structure 14 and the power supply cover 32 are provided to facilitate an electrical connection between the power supply electronics 28 in the power supply 12 and the light source module 34 of the lighting device 10.

In the illustrated embodiment, the light source module 34 employs light emitting diodes (LEDs) and associated control electronics, which are generally mounted to a printed circuit board (PCB). Among other functions, the control electronics are configured to drive the LEDs to generate light at a desired color, intensity and color temperature. Detailed operation of the light source module 34 is provided further below. The control electronics and LEDs are shown mounted on the front side of the PCB, while the rear side of the PCB is mounted to the front surface of the bottom panel 20 of the mounting structure 14 directly or via a thermally conductive pad (not shown). In this embodiment, the thermally conductive pad has a low thermal resistivity, and therefore, efficiently transfers heat that is generated by the light source module 34 to the bottom panel 20 of the mounting structure 14.

While various mounting mechanisms are available, the illustrated embodiment employs four bolts 44 to attach the PCB of the light source module 34 to the front surface of the bottom panel 20 of the mounting structure 14. The bolts 44 screw into threaded holes provided in the front surface of the bottom panel 20 of the mounting structure 14. Notably, the shape of the PCB is shown as being square, but the shape may be rectangular, circular, oval, polygonal, or the like.

A reflector cone 36 resides within the interior chamber provided by the mounting structure 14. In the illustrated embodiment, the reflector cone 36 has a conical wall that extends between a larger front opening and a smaller rear opening. The larger front opening resides at and substantially corresponds to the dimensions of front opening in the mounting structure 14 that corresponds to the front of the interior chamber provided by the mounting structure 14. The smaller rear opening of the reflector cone 36 resides about and substantially corresponds to the size of the LED or array of LEDs provided by the light source module 34. The front surface of the reflector cone 36 is generally, but not necessarily, highly reflective in an effort to increase the overall efficiency and optical performance of the lighting device 10.

In certain embodiments, the reflector cone 36 is formed from metal, paper, a polymer, or a combination thereof. In essence, the reflector cone 36 provides a mixing chamber for light emitted from the light source module 34 and may be used to help direct or control how the light exits the mixing chamber through the lens 16.

Figure 4:
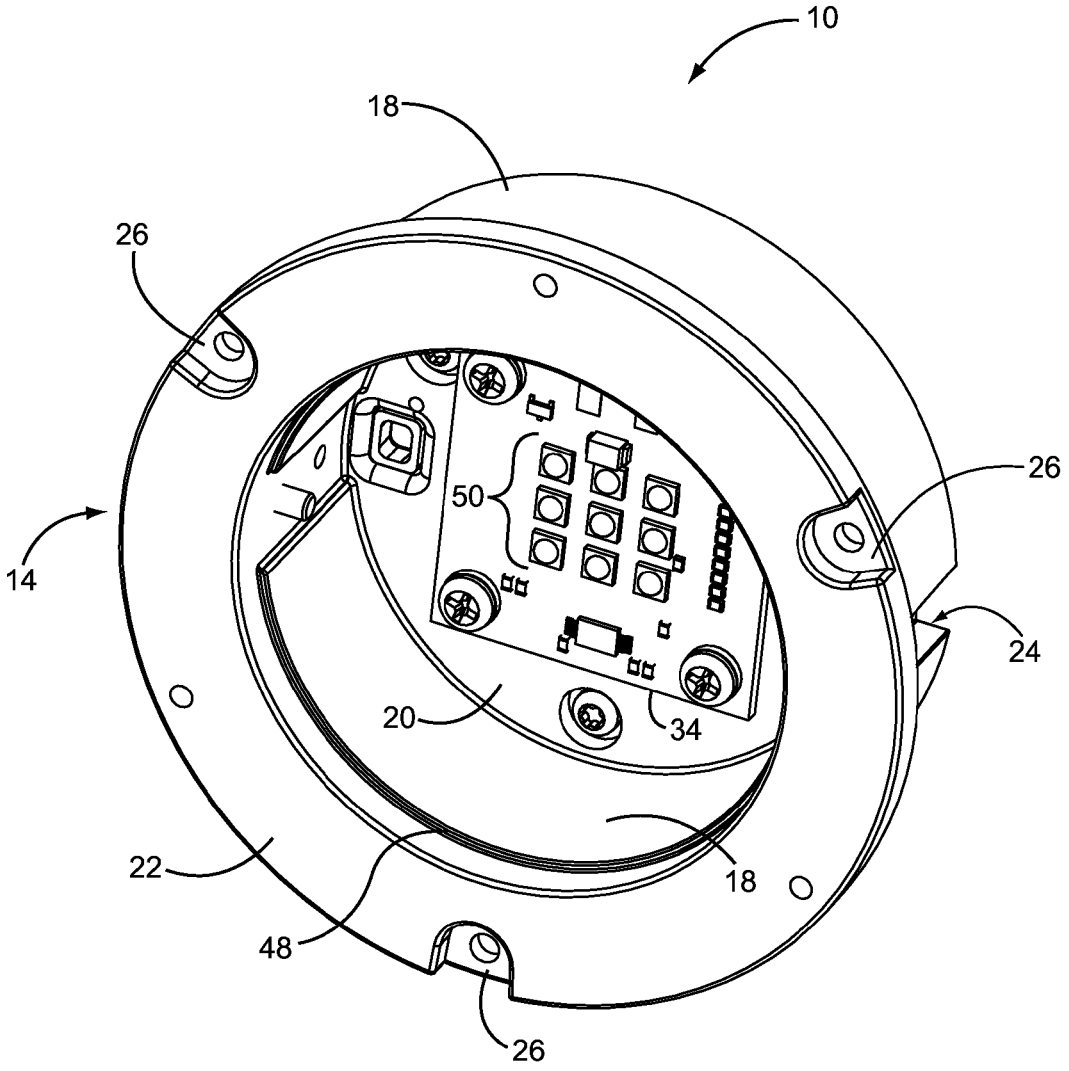
FIG. 4 is an isometric view of the front of the lighting device of FIG. 1 without the lens, diffuser, and reflector.
Figure 5:
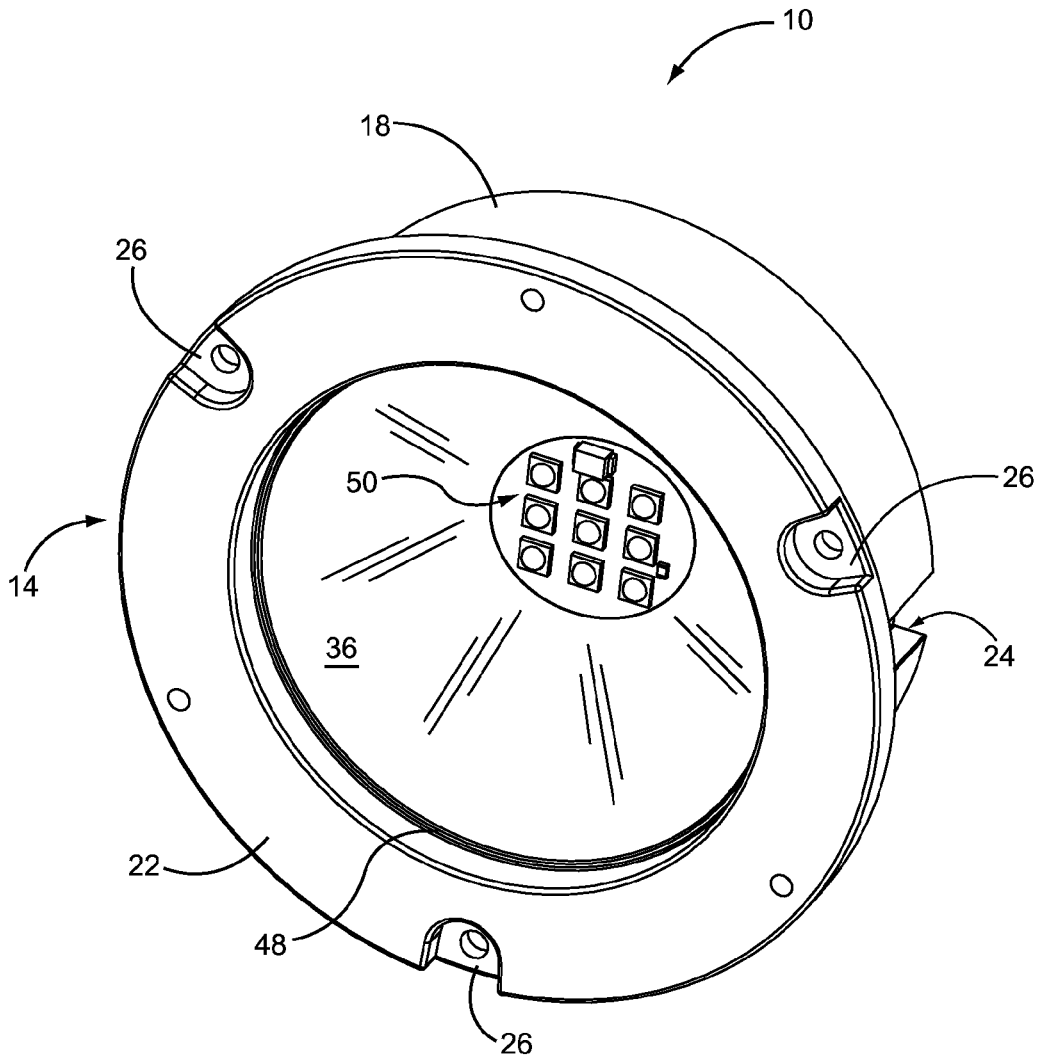
FIG. 5 is an isometric view of the front of the lighting device of FIG. 1 without the lens and diffuser.

When assembled, the lens 16 is mounted on or over the annular flange 22 and may be used to hold the reflector cone 36 in place within the interior chamber of the mounting structure 14 as well as hold additional lenses and one or more planar diffusers 38 in place. In the illustrated embodiment, the lens 16 and the diffuser 38 generally correspond in shape and size to the front opening of the mounting structure 14 and are mounted such that the front surface of the lens 16 is substantially flush with the front surface of the annular flange 22. As shown in FIGS. 4 and 5, a recess 48 is provided on the interior surface of the sidewall 18 and substantially around the opening of the mounting structure 14. The recess 48 provides a ledge on which the diffuser 38 and the lens 16 rest inside the mounting structure 14. The recess 48 may be sufficiently deep such that the front surface of the lens 16 is flush with the front surface of the annular flange 22.

Returning to FIG. 3B, the lens 16 may include tabs 40, which extend rearward from the outer periphery of the lens 16. The tabs 40 may slide into corresponding channels on the interior surface of the sidewall 18 (see FIG. 4). The channels are aligned with corresponding elongated slots 24 on the exterior of the sidewall 18. The tabs 40 have threaded holes that align with holes provided in the grooves and elongated slots 24. When the lens 16 resides in the recess 48 at the front opening of the mounting structure 14, the holes in the tabs 40 will align with the holes in the elongated slots 24. Bolts 42 may be inserted through the holes in the elongated slots and screwed into the holes provided in the tabs 40 to affix the lens 16 to the mounting structure 14. When the lens 16 is secured, the diffuser 38 is sandwiched between the lens 16 and the recess 48, and the reflector cone 36 is contained between the diffuser 38 and the light source module 34. Alternatively, a retention ring (not shown) may attach to the flange 22 of the mounting structure 14 and operate to hold the lens 16 and diffuser 38 in place.

The degree and type of diffusion provided by the diffuser 38 may vary from one embodiment to another. Further, color, translucency, or opaqueness of the diffuser 38 may vary from one embodiment to another. A separate diffuser 38, such as that illustrated in FIG. 3B, is typically formed from a polymer, glass, or thermoplastic, but other materials are viable and will be appreciated by those skilled in the art. Similarly, the lens 16 is planar and generally corresponds to the shape and size of the diffuser 38 as well as the front opening of the mounting structure 14. As with the diffuser 38, the material, color, translucency, or opaqueness of the lens 16 may vary from one embodiment to another. Further, both the diffuser 38 and the lens 16 may be formed from one or more materials or one or more layers of the same or different materials. While only one diffuser 38 and one lens 16 are depicted, the lighting device 10 may have multiple diffusers 38 or lenses 16.

For LED-based applications, the light source module 34 provides an array of LEDs 50, as illustrated in FIG. 4. FIG. 4 illustrates a front isometric view of the lighting device 10, with the lens 16, diffuser 38, and reflector cone 36 removed, such that the light source module 34 and the array of LEDs 50 are clearly visible within the mounting structure 14. FIG. 5 illustrates a front isometric view of the lighting device 10 with the lens 16 and the diffuser 38 removed and the reflector cone 36 in place showing the array of LEDs 50 of the light source module 34, which are aligned with the rear opening of the reflector cone 36. As noted above, the volume inside the reflector cone 36 is bounded by the rear opening of the reflector cone 36, and the lens 16 or the diffuser 38 provides a mixing chamber.

Figure 6:
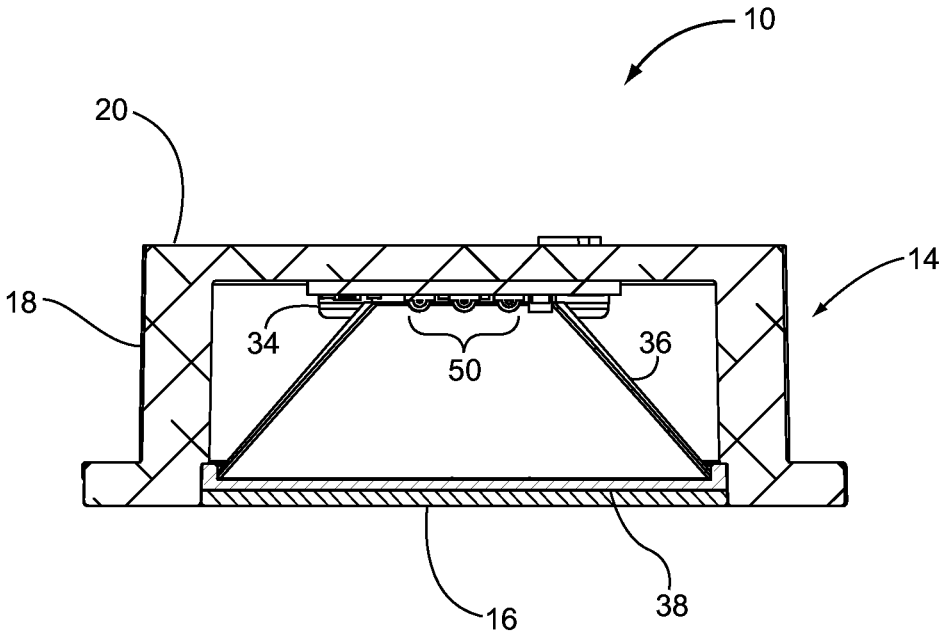
FIG. 6 is a cross-sectional view of the lighting device of FIG. 5.

Light emitted from the array of LEDs 50 is mixed inside the mixing chamber formed by the reflector cone 36 and directed out through the lens 16 in a forward direction to form a light beam. The array of LEDs 50 of the light source module 34 may include LEDs that emit different colors of light. For example, the array of LEDs 50 may include both red LEDs that emit reddish light and blue-shifted yellow (BSY) LEDs that emit bluish-yellow light or blue-shifted green (BSG) LEDs that emit bluish-green light, wherein the red and bluish-yellow or bluish-green light is mixed to form "white" light at a desired color temperature. In certain embodiments, the array of LEDs may include a large number of red LEDs and BSY or BSG LEDs in various ratios. For example, two or three BSY or BSG LEDs may be associated with each red LED, and the total number of LEDs may be 10, 25, 50, 100, or more depending on the application. FIGS. 4, 5, and 6 only show nine LEDs in the array of LEDs for clarity.

For a uniformly colored beam, relatively thorough mixing of the light emitted from the array of LEDs 50 is desired. Both the reflector cone 36 and the diffusion provided by the diffuser 38 play significant roles in mixing the light emanated from the array of LEDs 50 of the light source module 34. In particular, certain light rays, which are referred to as non-reflected light rays, emanate from the array of LEDs 50 and exit the mixing chamber through the diffuser 38 and lens 16 without being reflected off of the interior surface of the reflector cone 36. Other light rays, which are referred to as reflected light rays, emanate from the array of LEDs 50 of the light source module 34 and are reflected off the front surface of the reflector cone 36 one or more times before exiting the mixing chamber through the diffuser 38 and the lens 16. With these reflections, the reflected light rays are effectively mixed with each other and at least some of the non-reflected light rays within the mixing chamber before exiting the mixing chamber through the diffuser 38 and the lens 16.

As noted above, the diffuser 38 functions to diffuse, and as a result, mix the non-reflected and reflected light rays as they exit the mixing chamber, wherein the mixing chamber and the diffuser 38 provide the desired mixing of the light emanated from the array of LEDs 50 of the light source module 34 to provide a light beam of a consistent and desired color. In addition to mixing light rays, the lens 16 and diffuser 38 may be designed and the reflector cone 36 shaped in a manner to control the relative concentration and shape of the resulting light beam that is projected from the lighting device 10. For example, a first lighting device 10 may be designed to provide a concentrated beam for a spotlight, wherein another may be designed to provide a widely dispersed beam for a floodlight. From an aesthetics perspective, the diffusion provided by the diffuser 38 also prevents the emitted light from looking pixelated and obstructs the ability for a user to see the individual LEDs of the array of LEDs 50.

As provided in the above embodiment, the more traditional approach to diffusion is to provide a diffuser 38 that is separate from the lens 16. As such, the lens 16 is effectively transparent and does not add any intentional diffusion. The intentional diffusion is provided by the diffuser 38. In most instances, the diffuser 38 and lens 16 are positioned next to one another as shown in FIG. 6. However, in other embodiments, the diffusion may be integrated into the lens 16 itself.

Figure 7:
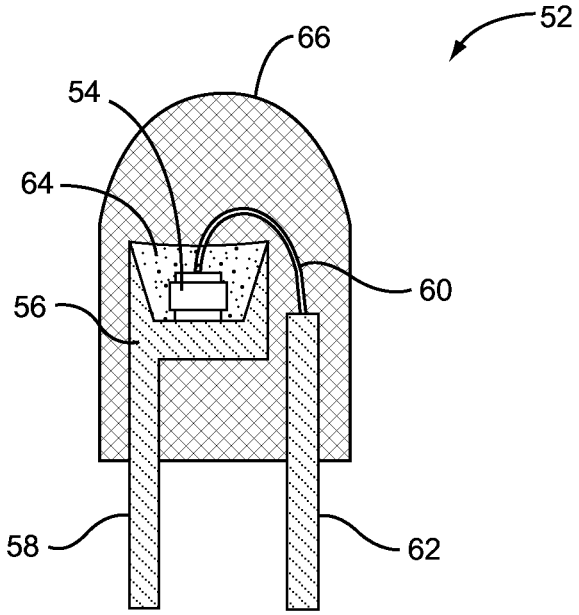
FIG. 7 is a cross-sectional view of a first type of LED architecture.

A traditional package for an LED 52 of the array of LEDs 50 is illustrated in FIG. 7. A single LED chip 54 is mounted on a reflective cup 56 using solder or a conductive epoxy, such that ohmic contacts for the cathode (or anode) of the LED chip 54 are electrically coupled to the bottom of the reflective cup 56. The reflective cup 56 is either coupled to or integrally formed with a first lead 58 of the LED 52. One or more bond wires 60 connect ohmic contacts for the anode (or cathode) of the LED chip 54 to a second lead 62.

The reflective cup 56 may be filled with an encapsulant material 64 that encapsulates the LED chip 54. The encapsulant material 64 may be clear or contain a wavelength conversion material, such as a phosphor, which is described in greater detail below. The entire assembly is encapsulated in a clear protective resin 66, which may be molded in the shape of a lens to control the light emitted from the LED chip 54.

Figure 8:
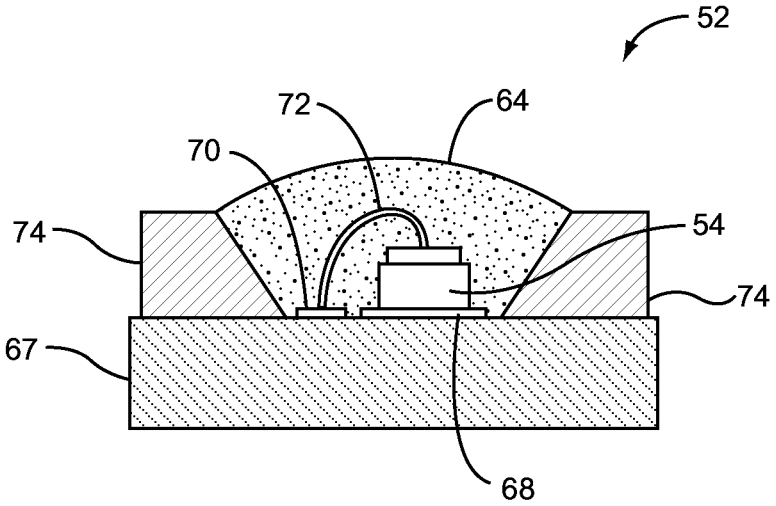
FIG. 8 is a cross-sectional view of a second type of LED architecture.

An alternative package for the LED 52 is illustrated in FIG. 8, wherein the LED chip 54 is mounted on a substrate 67. In particular, the ohmic contacts for the anode (or cathode) of the LED chip 54 are directly mounted to first contact pads 68 on the surface of the substrate 67. The ohmic contacts for the cathode (or anode) of the LED chip 54 are connected to second contact pads 70, which are also on the surface of the substrate 67, using bond wires 72. The LED chip 54 resides in a cavity of a reflector structure 74, which is formed from a reflective material and functions to reflect light emitted from the LED chip 54 through the opening formed by the reflector structure 74. The cavity formed by the reflector structure 74 may be filled with an encapsulant material 64 that encapsulates the LED chip 54. The encapsulant material 64 may be clear or contain a wavelength conversion material, such as a phosphor.

In either of the embodiments of FIGS. 7 and 8, if the encapsulant material 64 is clear, the light emitted by the LED chip 54 passes through the encapsulant material 64 and the protective resin 66 without any substantial shift in color. As such, the light emitted from the LED chip 54 is effectively the light emitted from the LED 52. If the encapsulant material 64 contains a wavelength conversion material, substantially all or a portion of the light emitted by the LED chip 54 in a first wavelength range may be absorbed by the wavelength conversion material, which will responsively emit light in a second wavelength range. The concentration and type of wavelength conversion material will dictate how much of the light emitted by the LED chip 54 is absorbed by the wavelength conversion material as well as the extent of the wavelength conversion. In embodiments where some of the light emitted by the LED chip 54 passes through the wavelength conversion material without being absorbed, the light passing through the wavelength conversion material will mix with the light emitted by the wavelength conversion material. Thus, when a wavelength conversion material is used, the light emitted from the LED 52 is shifted in color from the actual light emitted from the LED chip 54.

As noted above, the array of LEDs 50 may include a group of BSY or BSG LEDs 52 as well as a group of red LEDs 52. BSY LEDs 52 include an LED chip 54 that emits bluish light, and the wavelength conversion material is a yellow phosphor that absorbs the blue light and emits yellowish light. Even if some of the bluish light passes through the phosphor, the resultant mix of light emitted from the overall BSY LED 52 is yellowish light. The yellowish light emitted from a BSY LED 52 has a color point that typically falls above the Black Body Locus (BBL) on the 1931 CIE chromaticity diagram wherein the BBL corresponds to the various color temperatures of white light. According to one embodiment, the group of BSY or BSG LEDs 52 may include one or more BSY LEDs of a first type and one or more BSY LEDs of a second type. The BSY LEDs of the first type may have a color temperature that is different from the BSY LEDs of the second type in order to emit light at a desired color temperature.

Similarly, BSG LEDs 52 include an LED chip 54 that emits bluish light; however, the wavelength conversion material is a greenish phosphor that absorbs the blue light and emits greenish light. Even if some of the bluish light passes through the phosphor, the resultant mix of light emitted from the overall BSG LED 52 is greenish light. The greenish light emitted from a BSG LED 52 typically has a color point that also falls above the BBL on the 1931 CIE chromaticity diagram wherein the BBL corresponds to the various color temperatures of white light.

The red LEDs 52 generally emit reddish light at a color point on the opposite side of the BBL (or below) as the yellowish or greenish light of the BSY or BSG LEDs 52. As such, the reddish light from the red LEDs 52 mixes with the yellowish or greenish light emitted from the BSY or BSG LEDs 52 to generate white light that has a desired color temperature and falls within a desired proximity of the BBL. In effect, the reddish light from the red LEDs 52 pulls the yellowish or greenish light from the BSY or BSG LEDs 52 to a desired color point on or near the BBL. Notably, the red LEDs 52 may have LED chips 54 that natively emit reddish light wherein no wavelength conversion material is employed. Alternatively, the LED chips 54 may be associated with a wavelength conversion material, wherein the resultant light emitted from the wavelength conversion material and any light that is emitted from the LED chips 54 without being absorbed by the wavelength conversion material mixes to form the desired reddish light.

The blue LED chip 54 used to form either the BSY or BSG LEDs 52 may be formed from a gallium nitride (GaN), indium gallium nitride (InGaN), silicon carbide (SiC), zinc selenide (ZnSe), or like material system. The red LED chip 54 may be formed from an aluminum indium gallium nitride (AlInGaP), gallium phosphide (GaP), aluminum gallium arsenide (AlGaAs), or like material system. Exemplary yellow phosphors include cerium-doped yttrium aluminum garnet (YAG:Ce), yellow BOSE (Ba, O, Sr, Si, Eu) phosphors, and the like. Exemplary green phosphors include green BOSE phosphors, Lutetium aluminum garnet (LuAg), cerium doped LuAg (LuAg:Ce), Maui M535 from Lightscape Materials, Inc. of 201 Washington Road, Princeton, N.J. 08540, and the like. The above LED architectures, phosphors, and material systems are merely exemplary and are not intended to provide an exhaustive listing of architectures, phosphors, and materials systems that are applicable to the concepts disclosed herein.

Figure 9:
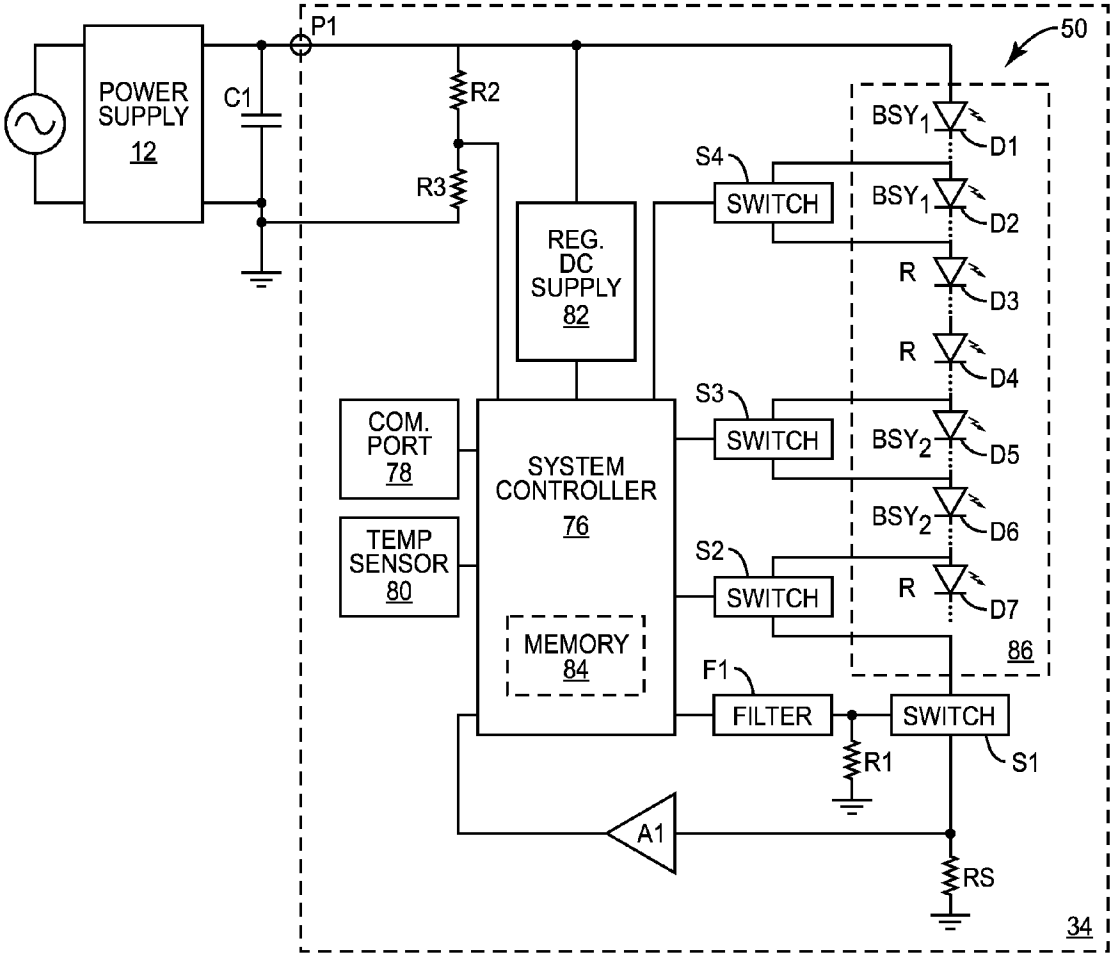
FIG. 9 is a schematic of the exemplary control module electronics according to a first embodiment of the disclosure.

As noted, the array of LEDs 50 on the light source module 34 may include a mixture of the red LEDs 52 and either the BSY or BSG LEDs 52. As illustrated in FIG. 9, the light source module 34 may also include a variety of control electronics, such as a system controller 76, a communication port 78, a temperature sensor 80, a regulated direct current (DC) supply 82, and memory 84. In this embodiment, the off-board power supply 12 receives a variable voltage AC signal, perhaps from a triac in a light switch (not shown) with dimming control, and provides a drive signal to port P1 of the light source module 34. The drive signal is provided at a level sufficient to drive the array of LEDs 50 at an intensity level generally commensurate to the desired lumen output of the array of LEDs 50 based on the level of dimming sensed from the AC signal received from the triac. As such, the drive signal may be variable and generally corresponds to the level of dimming set at the light switch. One or more capacitors C1 may be provided at the output of the power supply 12, either internally or externally as shown, in an effort to stabilize the voltage at which the drive current is provided to the array of LEDs 50.

According to one embodiment, the drive signal is a drive current provided through the array of LEDs 50. In other embodiments, the drive signal may be a drive voltage provided across the array of LEDs 50.

The drive signal provided by the power supply 12 may also be used to power the system controller 76. In this embodiment, the voltage provided at port P1 is regulated down by the regulated DC supply 82 to a relatively fixed voltage to power the system controller 76. In operation, the drive signal provided at port P1 is generally fixed at a maximum value for a maximum intensity level and at corresponding lesser values for any given level of dimming.

Notably, the array of LEDs 50 includes a first string of series connected LEDs 86, wherein the string is coupled between port P1 and a switch S1, which is coupled to ground directly or through a current sensing resistor RS, the purpose of which is described further below. For current to flow through the first string of series connected LEDs 86 in the illustrated embodiment, the system controller 76 must close switch S1, which may be a transistor, such as a bipolar junction transistor (BJT) or field-effect transistor (FET). In one embodiment, the switch S1 is an N-channel FET where the drain is coupled to the first string of series connected LEDs 86, the source is coupled to ground, and the gate is coupled to a control output of the system controller 76 and a pull down resistor R1, which is coupled to ground. As such, the N-channel FET (switch S1) is normally off (or open) absent the system controller 76 applying a positive voltage to the gate of the N-channel FET, because the resistor R1 will pull the gate of the N-channel FET to ground.

To direct current through the first string of series connected LEDs 86, the system controller 76 will cause a positive voltage to be applied to the gate of the N-channel FET. When the positive voltage is applied to the gate, the N-channel FET will turn on and effectively couple the first string of series connected LEDs 86 to ground such that current can flow through the first string of series connected LEDs 86. The flow of current from the drive signal will cause the LEDs D1-D7 in the first string of series connected LEDs 86 to emit light at an intensity that is generally proportional to the magnitude of the drive signal.

The system controller 76 may be capable of directly generating the necessary gate voltages to drive the switch S1. In the illustrated embodiment, however, the system controller 76 is further configured to provide a pulse width modulated (PWM) signal to a filter network F1, which is coupled to the gate of the transistor representing switch S1. In this configuration, the filter network F1 is a low pass filter that is capable of filtering the PWM signal to provide a variable DC signal. The voltage of the DC signal directly corresponds to the duty cycle of the PWM signal provided by the system controller. As discussed further below, the system controller 76 can control the duty cycle of the PWM signal to modulate the gate voltage provided to the transistor representing switch S1 in addition to simply turning the transistor on and off to close and open the switch S1.

As noted above, the array of LEDs 50, and thus each one of the first string of series connected LEDs 86, may be of different types. In FIG. 9, only seven LEDs D1-D7 are illustrated, but any number of LEDs may be employed and organized or connected in any number of subgroups. As illustrated, LEDs D1, D2, D5 and D6 are of a BSY type and emit yellowish light, and LEDs D3, D4, and D7 are of a red type (R) and emit reddish light. Further, LEDs D1 and D2 may be a first BSY type ($BSY_1$), while LEDs D5 and D6 may be a second BSY type ($BSY_2$), such that the first BSY type $BSY_1$ has a color temperature that is different from the second BSY type $BSY_2$. As noted, the reddish and yellowish light emitted from the various LEDs D1-D7 mix together to form "white" light at a desired color temperature.

Switches S2, S3, and S4 may be provided to effectively tune the color temperature, the intensity, or both the color temperature and intensity of the combined light emitted from the array of LEDs 50. As described below, the system controller 76 can use switch S2 to effectively control the amount of reddish light emitted from the array of LEDs 50 and can use switches S3 and S4 to effectively control the amount and type of yellowish light emitted by the array of LEDs 50.

Switch S2 is coupled across the red type LED D7 and controlled by the system controller 76. Switch S3 is coupled across the BSY type LED D5 and also controlled by the system controller 76. Switch S4 is coupled across the BSY type LED D2 and also controlled by the system controller 76. Closing the switches S2, S3, and S4 effectively provides an electrical short across the respective LEDs D7, D5, and D2, thus redirecting current around the LEDs D7, D5, and D2 through the switches S2, S3, and S4, respectively.

When switch S1 is closed and switches S2, S3, and S4 are open, current flows through the string of series connected LEDs D1-D7, including LEDs D7 and D5. If switch S2 is closed while switch S1 remains closed and switches S3 and S4 remain open, current bypasses LED D7, but still flows through LEDs D1-D6. If switch S3 is closed while switch S1 remains closed and switches S2 and S4 remain open, current bypasses LED D5, but still flows through LEDs D1-D4 and D6-D7. If switch S4 is closed while switch S1 remains closed and switches S2 and S3 remain open, current bypasses LED D2, but still flows through LEDs D1 and D3-D7. Closing switch S2 effectively turns off the red type LED D7 and reduces the amount of reddish light emitted by the array of LEDs 50. Closing switch S3 effectively turns off the BSY type LED D5 and reduces the amount of yellowish light emitted by the array of LEDs 50. Closing switch S4 effectively turns off the BSY type LED D2 and reduces the amount of yellowish light emitted by the array of LEDs 50.

In operation, the system controller 76 may drive the switches S2, S3, and S4 with individual PWM signals, each of which is effectively a series of pulses that rapidly switches the red type LED D7, the BSY type LED D5, and the BSY type LED D2 on and off while drive signal is being provided to the string of series connected LEDs D1-D7. The respective duty cycles for the PWM signals control how long the red type LED D7, the BSY type LED D5, and the BSY type LED D2 are on and off for a given cycle. As such, the duty cycle for the PWM signal that drives switch S2 controls the average intensity of reddish light emitted from the red type LED D7, and as such, controls the amount of reddish light the red type LED D7 adds to the overall light emitted from the other LEDs D1-D6. Similarly, the duty cycle for the PWM signal that drives switch S3 controls the average intensity of the yellowish light emitted from the BSY type LED D5, and as such, controls the amount of yellowish light the BSY type LED D5 adds to the overall light emitted from the other LEDs D1-D4 and D6-D7. Finally, the duty cycle for the PWM signal that drives the switch S4 controls the average intensity of the yellowish light emitted from the BSY type LED D2, and as such, controls the amount of yellowish light the BSY type LED D2 adds to the overall light emitted from the other LEDS D1 and D3-D7. While the intensity of reddish light emitted from LEDs D3 and D4 and the intensity of yellowish light emitted from LEDs D1 and D6 remain relatively constant for a given drive signal, the system controller 76 can control switches S2, S3, and S4 to individually effectively vary the intensity of the reddish light emitted from LED D7, the yellowish light emitted from LED D5, and the yellowish light emitted from LED D2, and thus the overall intensity and color temperature of the light emitted from the LEDs D1-D7 as a whole.

The switches S2, S3, and S4 may be transistors, such as BJTs or FETs. In one embodiment, switch S2 is an N-channel FET where the drain is coupled to the anode of LED D7, the source is coupled to the cathode of LED D7, and the gate is coupled to a control output of the system controller 76. Switch S3 is a P-channel FET where the drain is coupled to the anode of LED D5, the source is coupled to the cathode of LED D5, and the gate is coupled to a control output of the system controller 76. Switch S4 is a P-channel FET where the drain is coupled to the anode of LED D2, the source is coupled to the cathode of LED D2, and the gate is coupled to a control output of the system controller 76.

In order to properly operate the LEDs D1-D7, the system controller 76 may require an accurate measurement of the drive signal, which may be a drive current through the LEDs D1-D7 or a drive voltage across the LEDs D1-D7. According to one exemplary embodiment, the system controller 76 may require an accurate measurement of the drive current through the LEDs D1-D7 or the drive voltage across the LEDs D1-D7 in order to determine when the LEDs D1-D7 are being dimmed. Knowing when the LEDs D1-D7 are being dimmed may allow the system controller 76 to adjust the color temperature of the light emitted by the LEDs D1-D7 to accomplish a "sunset dimming" feature, as will be discussed in further detail below.

As previously discussed, LED lighting devices may behave differently than incandescent bulbs. For example, while the color temperature of the light emitted by an incandescent bulb changes as it is dimmed, generally becoming more red, the color temperature of an LED remains constant as it is dimmed. Accordingly, in order to more closely imitate the light emitted by an incandescent bulb, it may be desirable to change the color temperature of the light emitted by the LEDS D1-D7 as they are dimmed to include more red. As discussed above, the PWM drive signal to the second switch S2, the third switch S3, and the fourth switch S4 may be altered in order to change the color temperature of the light emitted from the LEDs D1-D7 in response to the measured current. The feature of adjusting the color temperature of a solid-state lighting device as the lighting device is dimmed in order to more closely imitate the light emitted by an incandescent bulb is referred to herein as "sunset dimming".

Additionally, an accurate measurement of the drive current through the LEDs D1-D7 or the drive voltage across the LEDs D1-D7 may be required in order to detect the occurrence of an over-current or over-voltage condition, respectively, which may cause damage to the LEDs D1-D7. Further, an accurate measurement of the drive current through the LEDs D1-D7 or the drive voltage across the LEDs D1-D7 may also allow the light source module to compensate the LEDs D1-D7 for a variety of drive currents and drive voltages, thereby offering flexibility in the power supply 12 used with the light source module 34. Those of ordinary skill in the art will appreciate that the accurate measurement of a drive current through the LEDs D1-D7 or a drive voltage across the LEDs D1-D7 may be required in a variety of situations, all of which are contemplated herein.

According to one embodiment of the present disclosure, the drive current through the LEDs D1-D7 is detected by sampling the voltage drop across the current sensing resistor RS as the current through the LEDs D1-D7 passes through the current sensing resistor RS. To reduce the additional power consumption and voltage drop induced by the current sensing resistor RS, the current sensing resistor RS may be very small, and an amplifier A1 may be included to amplify the voltage drop sensed across the sensing resistor RS to a level more readily processed by the system controller 76. In order to provide an accurate representation of the drive current through the LEDs D1-D7, the drive current may be sampled randomly or semi-randomly, and a moving average may be determined from the ongoing samples. In other words, the time between each current sample may be randomized or semi-randomized, and the ongoing sample values may be used to compute an average value. Sampling the drive current through the LEDs D1-D7 randomly or semi-randomly prevents errors in the measurement of the drive current signal that may be caused by synchronization of the sampling period with the frequency of interference in the drive current signal, while computing a moving average of the samples normalizes the samples for variations caused by interference in the signal. Measuring the drive current in this way prevents the continuous sampling of the drive current at the peak or valley of an extraneous ripple signal present in the drive current signal, which might otherwise skew the drive current measurement.

The sampling of the drive current and determination of the moving average may be performed, for example, by the system controller 76. Those of ordinary skill in the art will appreciate that the sampling and calculations described above may be performed by any portion of the light source module 34 without departing from the principles of the present disclosure, and may further be accomplished by an external module.

The term "semi-random", as used herein, is used to describe the use of a pre-defined set of delays between each sample, which may vary from sample to sample for a given period of time, then repeat itself. Using a semi-random sampling technique may offer the same advantages as a random sampling, but without the processing overhead required to generate a random sampling sequence.

In addition to the drive current, the system controller 76 may also require an accurate measurement of the drive voltage across the LEDs D1-D7. According to one embodiment of the present disclosure, the drive voltage across the LEDs D1-D7 is detected by sampling the output voltage of a voltage divider formed by a first voltage sensing resistor R2 and a second voltage sensing resistor R3. The first voltage sensing resistor R2 and the second voltage sensing resistor R3 are connected in series between port P1 and ground, with an output located between the connection point of the first voltage sensing resistor R2 and the second voltage sensing resistor R3. The voltage divider output is directly proportional to the voltage at port P1, and as such, the system controller 76 can monitor the voltage divider output and determine the actual or relative voltage at port P1.

As discussed above, sampling the drive voltage in a periodic manner may result in a skewed measurement, as the sampling period may undesirably synchronize with interference in the drive voltage signal provided at port P1. Accordingly, the drive voltage may be sampled randomly or semi-randomly, and a moving average may be calculated from the samples. As further discussed above, sampling the drive voltage across the LEDs D1-D7 randomly or semi-randomly prevents errors in the measurement of the drive voltage signal that may be caused by synchronization of the sampling period with the frequency of interference in the voltage signal, while computing a moving average off the samples normalizes the samples for variations caused by interference in the signal. Measuring the drive voltage in this way prevents the continuous sampling of voltage at the peak or valley of an extraneous ripple signal present in the drive voltage signal, which might otherwise skew the drive voltage measurement.

In some embodiments of the present disclosure, it may be desirable to discern the type of drive signal provided at port P1 by the power supply 12. As discussed above, the light source module 34 may be used with a variety of power supplies 12, which may provide power in the form of a linear drive signal, a PWM drive signal, or some combination of the two. Because of the differences between a linear drive signal and PWM drive signal, it is imperative to discern which type of power is being delivered to the LEDs D1-D7 in order to accurately measure the drive current through the LEDs D1-D7 and/or the drive voltage across the LEDs D1-D7. Failing to do so may result in false positives when attempting to discern, for example, whether the LEDs D1-D7 are being turned OFF or dimmed, which may interfere with the proper operation of the light source module 34.

According to one embodiment of the present disclosure, the drive signal to the LEDs D1-D7 (provided at port P1) is sampled and stored in a cyclical buffer, such that as new samples are stored in the buffer, older samples above the capacity of the buffer are pushed out of the buffer. The cyclical buffer may be stored, for example, in the memory 84 of the system controller 76. The drive signal at port P1 may be sampled as a drive voltage, in which case the signal may be sampled at the output voltage of the voltage divider formed by the first voltage sensing resistor R2 and the second voltage sensing resistor R3, or as a drive current, in which case the signal may be sampled across the current sensing resistor RS. The samples in the cyclical buffer are then used to calculate a variance between the samples, which may be defined as the difference between the maximum value in the buffer and the minimum value in the buffer. The variance of the samples may then be used to determine whether the LEDs D1-D7 are being driven by a linear drive signal or a PWM drive signal. Specifically, if the variance of the samples in the cyclical buffer is above a predetermined threshold, it may be determined that a PWM drive signal is being used. Otherwise, it may be determined that a linear drive signal is being used. In some cases, it may be determined that a PWM drive signal is used to drive the LEDs D1-D7 at a first level, while a linear drive signal is used to drive the LEDs D1-D7 at a second level.

According to one embodiment, the samples stored in the cyclical buffer correspond to the length of the longest PWM period that is expected to be delivered to the array of LEDs 50. Further, the sampling of the drive current or the drive voltage may be performed randomly or semi-randomly to avoid synchronization with interference in the input drive signal, as discussed above.

The sampling of the drive signal and subsequent calculations may be accomplished, for example, by the system controller 76. Those of ordinary skill in the art will appreciate that the sampling and calculations described above may be performed by any portion of the light source module 34 without departing from the principles of the present disclosure, and may further be accomplished by an external module.

The determination of the type of drive signal provided to the LEDs D1-D7 may allow for accurate prediction of certain events, for example, when the LEDs D1-D7 are being turned off or dimmed. For example, while the amplitude of a linear drive signal declines as the LEDs D1-D7 are being turned off, a PWM drive signal will generally fall to zero many times within a given period, which may elicit false positives regarding whether or not the LEDs D1-D7 are being shut off. Determining the type of drive signal provided to the LEDs D1-D7 may thus allow the light source module 34 to accurately predict when the LEDs D1-D7 are being turned off regardless of the type of power supply 12 used.

According to one embodiment, the communication port 78 is used to deliver information through one port of the system controller 76. This port is initially configured as an input. However, if an event occurs which requires notification to an external source, the system controller 76 may reconfigure the port to an output and set one or more logical bits indicating the occurrence of the event. As such, an investigator may simply analyze the output of the communication port 78 to determine the status of the light source module 34.

According to one embodiment, the temperature sensor 80 is used to monitor the temperature of, at, or proximate to the light source module 34 in an effort to identify over-temperature conditions which may degrade the performance and longevity of the light source module 34.

Figure 10:
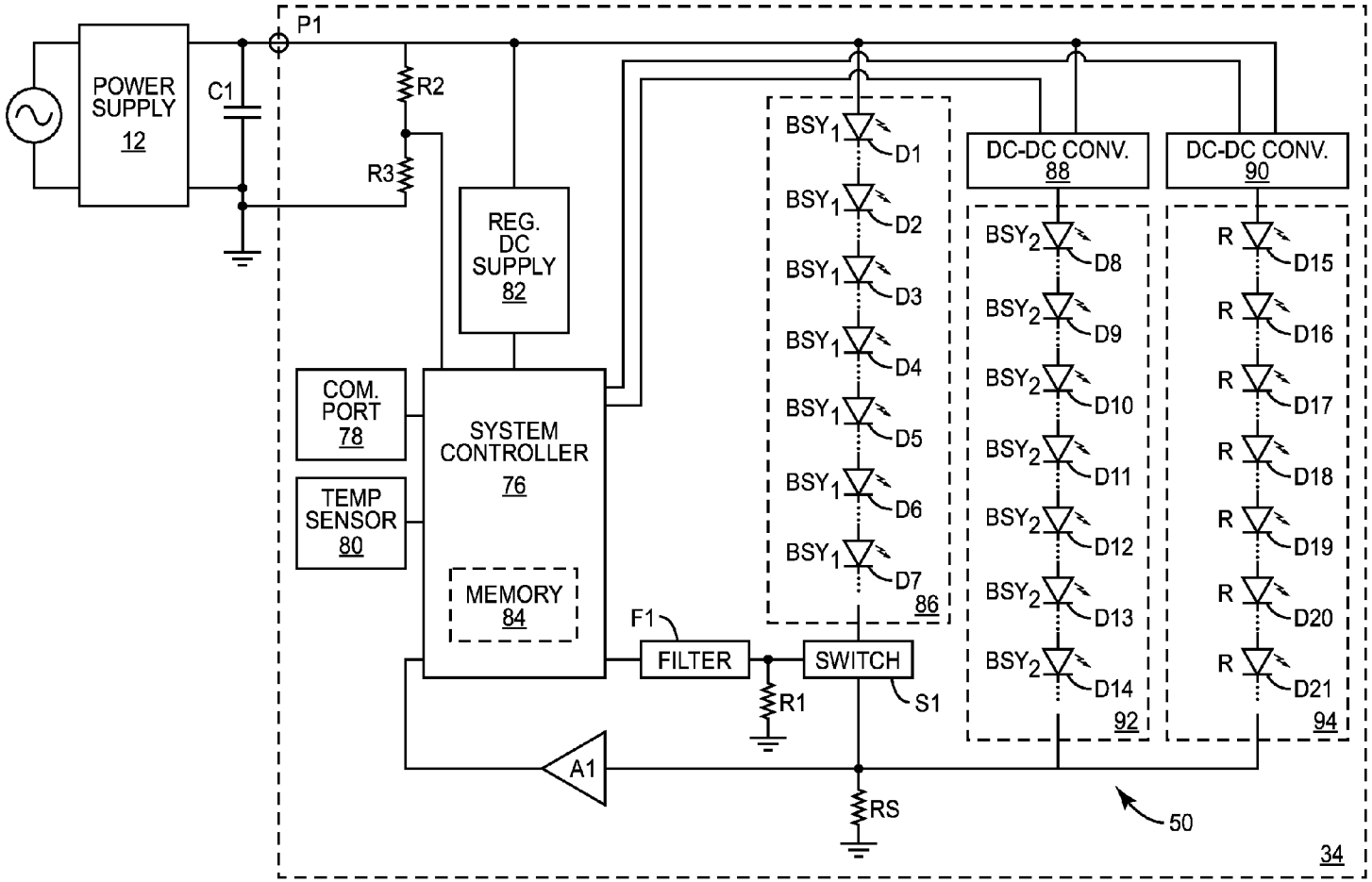
FIG. 10 is a schematic of the exemplary control module electronics according to a second embodiment of the disclosure.

FIG. 10 shows the light source module 34 according to an additional embodiment of the present disclosure. The light source module 34 shown in FIG. 10 may be substantially similar to that shown in FIG. 9, except that the light source module 34 shown in FIG. 10 may omit the second switch S2, the third switch S3, and the fourth switch S4, and may further include a first DC-DC converter 88, a second DC-DC converter 90, a second string of series connected LEDs 92, and a third string of series connected LEDs 94. The first DC-DC converter 88 may be connected between port P1 and the second string of series connected LEDs 92, which are connected between the first DC-DC converter 88 and the current sensing resistor RS. The second DC-DC converter 90 may be connected between port P1 and the third string of series connected LEDs 94, which are connected between the second DC-DC converter 90 and the current sensing resistor RS. Each one of the first DC-DC converter 88 and the second DC-DC converter 90 may have a control port coupled to the system controller 76, such that the system controller 76 controls the amount of current and voltage supplied to the second string of series connected LEDs 92 and the third string of series connected LEDs 94 via the first DC-DC converter 88 and the second DC-DC converter 90, respectively.

According to one embodiment, the first DC-DC converter 88 and the second DC-DC converter 90 are buck converters. Those of ordinary skill in the art will appreciate that the first DC-DC converter 88 and the second DC-DC converter 90 may be any type of DC-DC converter capable of regulating the drive current through and/or the drive voltage across the second string of series connected LEDs 92 and the third string of series connected LEDs 94, respectively.

According to one embodiment, the first string of series connected LEDs 86 includes LEDs D1-D7, which are BSY LEDs of a first type ($BSY_1$), the second string of series connected LEDs 92 includes LEDs D8-D14, which are BSY LEDs of a second type ($BSY_2$), and the third string of series connected LEDs 94 includes LEDs D15-D21, which are red LEDs. By varying the amount of current through each one of the first string of series connected LEDs 86, the second string of series connected LEDs 92, and the third string of series connected LEDs 94, the color temperature of the light emitted by the array of LEDs 50 can be adjusted.

As discussed above, in order to properly operate the LEDs D1-D21, the system controller 76 may require an accurate measurement of the drive current through the LEDs D1-D21 or the drive voltage across the LEDs D1-D21. According to one exemplary embodiment, the system controller 76 may require an accurate measurement of the drive current through the LEDs D1-D21 or the drive voltage across the LEDs D1-D21 in order to determine when the LEDs D1-D21 are being dimmed. Knowing when the LEDs D1-D21 are being dimmed may allow the system controller 76 to adjust the color temperature of the light emitted by the LEDs D1-D21 to accomplish a "sunset dimming" feature, as will be discussed in further detail below.

As previously discussed, LED lighting devices may behave differently than incandescent bulbs. For example, while the color temperature of the light emitted by an incandescent bulb changes as it is dimmed, generally becoming more red, the color temperature of an LED remains constant as it is dimmed. Accordingly, in order to more closely imitate the light emitted by an incandescent bulb, it may be desirable to change the color temperature of the light emitted by the LEDs D1-D21 as they are dimmed to include more red. As discussed above, the control signals to the first switch S1, the first DC-DC converter 88, and the second DC-DC converter 90 may be altered in order to change the color temperature of the light emitted from the LEDs D1-D21 in response to the measured current. As discussed above, the feature of adjusting the color temperature of a solid-state lighting device as the lighting device is dimmed in order to more closely imitate the light emitted by an incandescent bulb is referred to herein as "sunset dimming".

Additionally, an accurate measurement of the drive current through the LEDs D1-D21 or the drive voltage across the LEDs D1-D21 may be required in order to detect the occurrence of an over-current or over-voltage condition, respectively, which may cause damage to the LEDs D1-D21. Further, an accurate measurement of the drive current through the LEDs D1-D21 or the drive voltage across the LEDs D1-D21 may also allow the light source module 34 to compensate the LEDs D1-D21 for a variety of drive currents and voltages, thereby offering flexibility in the power supply 12 used with the light source module 34. Those of ordinary skill in the art will appreciate that the accurate measurement of a drive current through the LEDs D1-D21 or a drive voltage across the LEDs D1-D21 may be required in a variety of situations, all of which are contemplated herein.

According to one embodiment of the present disclosure, the drive current through the LEDs D1-D21 is detected by sampling the voltage drop across the current sensing resistor RS as the current through the LEDs D1-D21 passes through the current sensing resistor RS. To reduce the additional power consumption and voltage drop induced by the current sensing resistor RS, the current sensing resistor RS may be very small, and an amplifier A1 may be included to amplify the voltage drop sensed across the sensing resistor RS to a level more readily processed by the system controller 76. In order to provide an accurate representation of the current through the LEDs D1-D21, the drive current may be sampled randomly or semi-randomly, and a moving average may be calculated off the ongoing samples. In other words, the time between each current sample may be randomized or semi-randomized, and the ongoing sample values may be used to compute an average value. Sampling the drive current through the LEDs D1-D21 randomly or semi-randomly prevents errors in the measurement of the drive current signal that may be caused by synchronization of the sampling period with the frequency of interference in the drive current signal, while computing a moving average of the samples normalizes the samples for variations caused by interference in the signal. Measuring the drive current in this way prevents the continuous sampling of the drive current at the peak or valley of an extraneous ripple signal present in the drive current signal, which might otherwise skew the drive current measurement.

The sampling of the drive current and calculation of the moving average may be performed, for example, by the system controller 76. Those of ordinary skill in the art will appreciate that the sampling and calculations described above may be performed by any portion of the light source module 34 without departing from the principles of the present disclosure, and may further be accomplished by an external module.

In addition to the drive current, the system controller 76 may also require an accurate measurement of the drive voltage across the LEDs D1-D21. According to one embodiment of the present disclosure, the voltage across the LEDs D1-D21 is detected by sampling the output voltage of the voltage divider formed by the first voltage sensing resistor R2 and the second voltage sensing resistor R3. Because the voltage divider output is directly proportional to the voltage at port P1, the system controller 76 can monitor the voltage divider output and determine the actual or relative voltage at port P1.

As discussed above, sampling the drive voltage in a periodic manner may result in a skewed measurement, as the sampling period may undesirably synchronize with interference in the voltage signal provided at port P1. Accordingly, the drive voltage may be sampled randomly or semi-randomly, and a moving average may be calculated of the samples. As further discussed above, sampling the voltage across the LEDs D1-D21 randomly or semi-randomly prevents errors in the measurement of the drive voltage signal that may be caused by the synchronization of the sampling period with the frequency of interference in the current signal, while computing a moving average of the samples normalizes the samples for variations caused by interference in the signal. Measuring the drive voltage in this way prevents the continuous sampling of the drive voltage at the peak or valley of an extraneous ripple present in the drive voltage signal, which may otherwise skew the drive voltage measurement.

In some embodiments of the present disclosure, it may be desirable to discern the type of drive signal provided at port P1 by the power supply 12. As discussed above, the light source module 34 may be used with a variety of power supplies 12, which may provide power in the form of a linear drive signal, a PWM drive signal, or some combination of the two. Because of the differences between a linear drive signal and PWM drive signal, it is imperative to discern which type of power is being delivered to the LEDs D1-D21 in order to accurately measure the current through the LEDs D1-D21 and the voltage across the LEDs D1-D21. Failing to do so may result in false positives when attempting to discern, for example, whether the LEDs D1-D21 are being turned OFF or dimmed, which may interfere with the proper operation of the light source module 34.

According to one embodiment of the present disclosure, the drive signal to the LEDs D1-D21 (provided at port P1) is sampled and stored in a cyclical buffer, such that as new samples are stored in the buffer, older samples above the capacity of the buffer are pushed out of the buffer. The cyclical buffer may be stored, for example, in the memory 84 of the system controller 76. The drive signal at port P1 may be sampled as a drive voltage, in which case the signal may be sampled at the output voltage of the voltage divider formed by the first voltage sensing resistor R2 and the second voltage sensing resistor R3, or as a drive current, in which case the signal may be sampled across the current sensing resistor RS. The samples in the cyclical buffer are then used to calculate a variance between the samples, which may be defined as the difference between the maximum value in the buffer and the minimum value in the buffer. The variance of the samples may then be used to determine whether the LEDs D1-D21 are being driven by a linear drive signal or a PWM drive signal. Specifically, if the variance of the samples in the cyclical buffer is above a predetermined threshold, it may be determined that a PWM drive signal is being used. Otherwise, it may be determined that a linear drive signal is being used. In some cases, it may be determined that a PWM drive signal is used to drive the LEDs D1-D21 at a first level, while a linear drive signal is used to drive the LEDs D1-D21 at a second level.

According to one embodiment, the samples stored in the cyclical buffer correspond to the length of the longest PWM period that is expected to be delivered to the array of LEDs 50. Further, the sampling of current or voltage may be performed randomly or semi-randomly to avoid synchronization with interference in the drive signal, as discussed above.

The sampling of the drive signal and subsequent calculations may be accomplished, for example, by the system controller 76. Those of ordinary skill in the art will appreciate that the sampling and calculations described above may be performed by any portion of the light source module 34 without departing from the principles of the present disclosure, and may further be accomplished by an external module.

The determination of the type of drive signal provided to the LEDs D1-D21 may allow for accurate prediction of certain events, for example, when the LEDs D1-D21 are being turned off or dimmed. For example, while the amplitude of a linear drive signal declines as the LEDs D1-D21 are being turned off, a PWM drive signal will generally fall to zero many times within a given period, which may elicit false positives regarding whether or not the LEDs D1-D21 are being shut off. Determining the type of drive signal provided to the LEDs D1-D21 may thus allow the light source module 34 to accurately predict when the LEDs D1-D21 are being turned off regardless of the type of power supply 12 used.

Accurately determining when the LEDs D1-D21 are shutting off may be important, as the behavior of the light source module 34 may behave undesirably as the input drive signal from a linear power supply 12 falls below a threshold value. As discussed above, the third string of series connected LEDs 94 contains a plurality of red LEDs D15-D21, which may have a lower barrier voltage than the BSY LEDs D1-D14. Accordingly, if a linear drive signal is used to power the LEDs D1-D21, the BSY LEDs D1-D14 may shut off when the voltage drops below a certain threshold, while the red LEDs D15-D21 may remain on, resulting in the production of purely red light for some period of time. By using the method described above to detect the type of drive signal provided to the LEDs D1-D21, the system controller 76 can detect when the LEDs D1-D21 are being shut off regardless of the type of power supply 12 used, and cut power to each one of the first string of series connected LEDS 86, the second string of series connected LEDs 92, and the third string of series connected LEDS 94 so that all of the LEDs D1-D21 shut off at the same time.

What is claimed is:

1. A lighting device comprising:

an array of light emitting diodes (LEDs) coupled between a power supply node and ground; and a system controller configured to:

monitor an input signal provided at the power supply node to the array of LEDs;

determine whether the input signal is a pulse width modulated (PWM) signal or a linear signal; and if it is determined that the input signal provided at the power supply node is linear, determine an average value of at least one of a drive current through the array of LEDs or a drive voltage across the array of LEDs.

2. The lighting device of claim 1 wherein determining whether the input signal is a PWM signal or a linear signal comprises:

sampling one of the drive current through the array of LEDs or the drive voltage across the array of LEDs, and storing the sampled value in a cyclical buffer;

determining a variance of the samples stored in the cyclical buffer; and determining whether the input signal is a PWM signal or a linear signal based on the variance.

3. The lighting device of claim 2 wherein determining whether the input signal is a PWM signal or a linear signal based on the variance comprises comparing the variance to a predetermined threshold value.

4. The lighting device of claim 1 wherein, if the average value of one of the drive current through the array of LEDs or the drive voltage across the array of LEDs is below a predetermined threshold value, a flow of current is prevented through the array of LEDs.

5. The lighting device of claim 1 wherein the array of LEDs comprises a first string of series connected LEDs and a second string of series connected LEDs, such that the color temperature of the first string of series connected LEDs is different from the color temperature of the second string of series connected LEDs.

6. The lighting device of claim 5 wherein the intensity of one or more LEDs in the first string of series connected LEDs and the second string of series connected LEDs is adjusted by the system controller to control the color temperature of the light emitted from the array of LEDs.

7. The lighting device of claim 5 wherein the LEDs in the second string of series connected LEDs have a lower barrier voltage than the LEDs of the first string of series connected LEDs.

8. The lighting device of claim 7 wherein, if the average value of one of the drive current through the array of LEDs or the drive voltage across the array of LEDs is below a predetermined threshold value, a flow of current is prevented through the array of LEDs in order to prevent the second string of series connected LEDs from remaining on after the first string of series connected LEDs has turned off.

9. A lighting device comprising:

an array of light emitting diodes (LEDs) coupled between a power supply node and ground; and a system controller configured to:

sample at least one of a drive current through the array of LEDs or a drive voltage across the array of LEDs, and storing the sampled value in a cyclical buffer;

determine a variance of the samples stored in the cyclical buffer; and determine whether an input signal provided at the power supply node to the array of LEDs is a pulse width modulated (PWM) signal or a linear signal based on the variance.

10. The lighting device of claim 9 wherein determining whether the input signal provided at the power supply node to the array of LEDs is a PWM signal or a linear signal based on the variance comprises comparing the variance to a predetermined threshold.

11. The lighting device of claim 9 wherein the array of LEDs comprises a first string of series connected LEDs coupled between the power supply node and ground.

12. The lighting device of claim 11 wherein the array of LEDs further comprises:

a second string of series connected LEDs coupled in parallel with the first string of series connected LEDs between the power supply node and ground; and a third string of series connected LEDs coupled in parallel with the first string of series connected LEDs and the second string of series connected LEDs between the power supply node and ground.

13. The lighting device of claim 12 wherein the first string of series connected LEDs comprises blue-shifted yellow (BSY) LEDs of a first type, the second string of series connected LEDs comprises BSY LEDs of a second type, and the third string of series connected LEDs comprises red LEDs, such that the first type of BSY LEDs has a color temperature that is different from the second type of BSY LEDs.

14. The lighting device of claim 13 wherein the red LEDs in the third string of series connected LEDs have a lower barrier voltage than the BSY LEDs of the first type in the first string of series connected LEDs and the BSY LEDs of the second type in the second string of series connected LEDs.

15. The lighting device of claim 14 wherein, if it is determined that the input signal provided at the power supply node is linear, the system controller is further configured to determine an average value of one of the drive current through the array of LEDs or the drive voltage across the array of LEDs.

16. The lighting device of claim 15 wherein, if the average value of the drive current through the array of LEDs or the drive voltage across the array of LEDs is less than a predetermined threshold, the flow of current is prevented through the array of LEDs in order to prevent the third string of series connected LEDs from remaining on after the first string of series connected LEDs and the second string of series connected LEDs have turned off.

17. The lighting device of claim 13 wherein the intensity of one or more LEDs in the first string of series connected LEDs, the second string of series connected LEDs, and the third string of series connected LEDs is adjusted by the system controller to control the color temperature of the light emitted from the array of LEDs.

18. The lighting device of claim 9 further comprising a current sensing resistor coupled between the array of LEDs and ground.

19. The lighting device of claim 18 wherein the drive current is sampled by the system controller by measuring the voltage across the current sensing resistor.

20. The lighting device of claim 9 further comprising a voltage divider coupled between the power supply node and ground, the voltage divider including an output that is proportional to the voltage across the array of LEDs.

21. The lighting device of claim 20 wherein the drive voltage across the array of LEDs is sampled by the system controller by measuring a voltage at the output of the voltage divider.

22. A method for determining whether an input signal to an array of LEDs coupled between a power supply node and ground in a lighting device is a pulse width modulated (PWM) signal or a linear signal, the method comprising:

sampling at least one of a drive current through the array of LEDs or a drive voltage across the array of LEDs, and storing the sampled value in a cyclical buffer;

determining the variance of the samples stored in the cyclical buffer; and determining whether the input signal is a PWM signal or a linear signal based on the variance.

23. The method of claim 22 wherein determining whether the input signal is a PWM signal or a linear signal based on the variance comprises comparing the variance to a predetermined threshold.

24. The method of claim 22 wherein the array of LEDs comprises a first string of series connected LEDs coupled between the power supply node and ground.

25. The method of claim 24 wherein the array of LEDs further comprises:

a second string of series connected LEDs coupled in parallel with the first string of series connected LEDs between the power supply node and ground; and a third string of series connected LEDs coupled in parallel with the first string of series connected LEDs and the second string of series connected LEDs between the power supply node and ground.

26. The method of claim 25 wherein the first string of series connected LEDs comprises blue-shifted yellow (BSY) LEDs of a first type, the second string of series connected LEDs comprises BSY LEDs of a second type, and the third string of series connected LEDs comprises red LEDs, such that the first type of BSY LEDs has a color temperature that is different from the second type of BSY LEDs.

27. The method of claim 26 wherein the red LEDs in the third string of series connected LEDs have a lower barrier voltage than the BSY LEDs of the first type in the first string of series connected LEDs and the BSY LEDs of the second type in the second string of series connected LEDs.

28. The method of claim 27 wherein, if it is determined that the input signal provided at the power supply node is linear, the drive current through the array of LEDs or the drive voltage across the array of LEDs is measured.

29. The method of claim 28 wherein, if the drive current through the array of LEDs or the drive voltage across the array of LEDs is less than a predetermined threshold, current flow through the array of LEDs is prevented in order to prevent the third string of series connected LEDs from remaining on after the first string of series connected LEDs and the second string of series connected LEDs have turned off.

30. The method of claim 26 wherein the intensity of one or more LEDs in the first string of series connected LEDs, the second string of series connected LEDs, and the third string of series connected LEDs is adjusted by the system controller to control the color temperature of the light emitted from the array of LEDs.

31. The method of claim 22 further comprising a current sensing resistor coupled between the array of LEDs and ground.

32. The method of claim 31 wherein the drive current is sampled by the system controller by measuring a voltage across the current sensing resistor.

33. The method of claim 22 further comprising a voltage divider coupled between the power supply node and ground, the voltage divider including an output that is proportional to the voltage across the array of LEDs.

34. The method of claim 33 wherein the drive voltage across the array of LEDs is sampled by the system controller by measuring a voltage at the output of the voltage divider.

* * * * *